US010370953B2

(12) United States Patent
Dorban et al.

(10) Patent No.: US 10,370,953 B2
(45) Date of Patent: Aug. 6, 2019

(54) LOAD-MONITORING SENSOR PROXIMATE TO A SHIFTING DEVICE

(71) Applicant: Schlumberger Technology Corporation, Sugar Land, TX (US)

(72) Inventors: Andrew Dorban, Houston, TX (US); Michael Huh, Pearland, TX (US); Seth Conaway, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 243 days.

(21) Appl. No.: 15/246,916

(22) Filed: Aug. 25, 2016

(65) Prior Publication Data

US 2018/0058190 A1 Mar. 1, 2018

(51) Int. Cl.
*E21B 43/04* (2006.01)
*E21B 47/00* (2012.01)

(52) U.S. Cl.
CPC ..... *E21B 47/0006* (2013.01); *E21B 43/04* (2013.01)

(58) Field of Classification Search
CPC .... E21B 47/0006; E21B 47/06; E21B 47/065; E21B 47/022; E21B 43/02; E21B 34/14; E21B 2034/007
See application file for complete search history.

(56) References Cited

U.S. PATENT DOCUMENTS 5,309,988 A * 5/1994 Shy ..... E21B 34/14 166/237

* cited by examiner

*Primary Examiner* — Brad Harcourt
*Assistant Examiner* — David Carroll

(57) ABSTRACT

A downhole tool includes a shifting device and a load-monitoring sensor positioned above the shifting device. A distance between the shifting device and the load-monitoring sensor is less than or equal to about 10 m.

18 Claims, 6 Drawing Sheets

LOAD-MONITORING SENSOR PROXIMATE TO A SHIFTING DEVICE

BACKGROUND

A shifting device is a part of a downhole tool that may be used to shift one or more sleeves in a wellbore. For example, a completion assembly positioned within the wellbore may include a plurality of sleeves that are axially-offset from one another. The downhole tool may be run inside the completion assembly, and an engagement member (e.g., a collet) on the shifting device may be used to engage a first of the sleeves. Once engaged, the downhole tool is moved axially to shift the first sleeve from a first position (e.g., closed) to a second position (e.g., open). The engagement member may then disengage the first sleeve, and the downhole tool may be moved axially until the engagement member engages a second of the sleeves, where the process may be repeated. Rather than disengaging the first sleeve, the downhole tool may instead be moved axially to shift the first sleeve from the second position back to the first position, after which time the engagement member may disengage the first sleeve, and the downhole tool may be moved axially until the engagement member engages a second of the sleeves, where the process may be repeated.

It may be desirable to know the load on the shifting device when the shifting device engages and/or shifts the sleeves. For example, this knowledge may be used to identify sleeves that are not functioning (e.g., shifting) properly. The load on the shifting device may be determined by monitoring the hook load at the surface. However, monitoring the hook load may yield inaccurate results when the drill string is made up of multiple segments/joints that have different properties (e.g., inner diameter, outer diameter, material grade, etc.). Monitoring the hook load may also yield inaccurate results when the wellbore includes one or more deviated or horizontal sections or when there are restrictions in the wellbore. Currently, the load is determined in deviated and horizontal wellbores using one-time shear indicators. However, one-time shear indicators cannot measure the load for multiple sleeves.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A downhole tool is disclosed. The downhole tool includes a shifting device and a load-monitoring sensor positioned above the shifting device. A distance between the shifting device and the load-monitoring sensor is less than or equal to about 10 m.

In another embodiment, the downhole tool includes a sand control device, a tubular member, a shifting device, and a load-monitoring sensor. The tubular member is coupled to and positioned below the sand control device. The shifting device is coupled to the tubular member. The load-monitoring sensor is coupled to the tubular member and positioned between the sand control device and the shifting device.

A method for determining a load on a downhole tool is also disclosed. The method includes running the downhole tool into a wellbore. The downhole tool includes a sand control device, a tubular member coupled to and positioned below the sand control device, a shifting device coupled to the tubular member, and a load-monitoring sensor coupled to the tubular member and positioned between the sand control device and the shifting device. The method also includes moving the downhole tool within the wellbore until the shifting device contacts a restriction in the wellbore. The method further includes measuring, with the load-monitoring sensor, a load on the downhole tool caused by the contact between the shifting device and the restriction.

BRIEF DESCRIPTION OF THE DRAWINGS

The accompanying drawings, which are incorporated in and constitute a part of this specification, illustrate embodiments of the present teachings and together with the description, serve to explain the principles of the present teachings. In the figures.

DETAILED DESCRIPTION

Reference will now be made in detail to embodiments, examples of which are illustrated in the accompanying figures. In the following detailed description, numerous specific details are set forth in order to provide a thorough understanding of the present disclosure. However, it will be apparent to one of ordinary skill in the art that the system and method disclosed herein may be practiced without these specific details.

Figure 1:
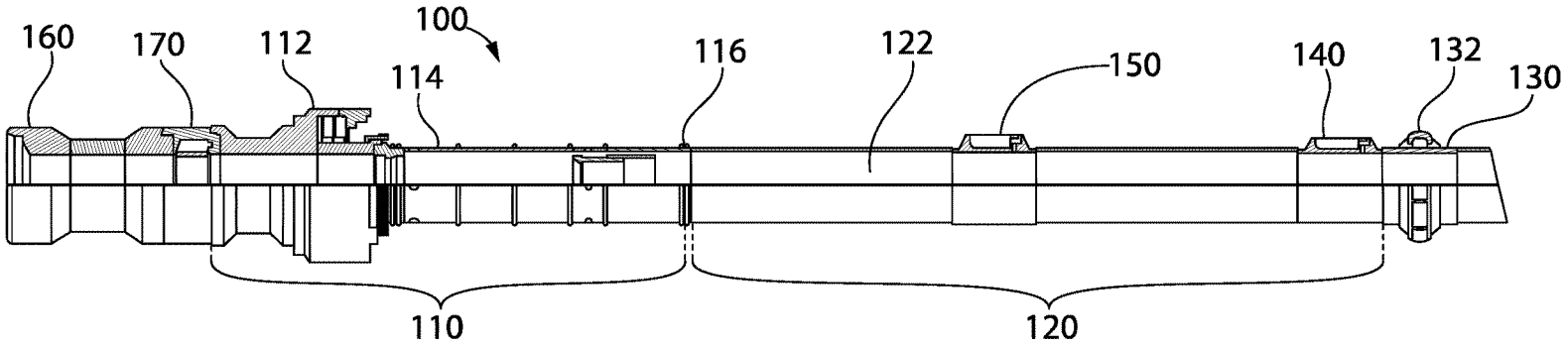
FIG. 1 illustrates a half-sectional side view of a downhole tool, according to an embodiment.

FIG. 1 illustrates a half-sectional side view of a downhole tool 100, according to an embodiment. The downhole tool 100 may include a sand control device 110. The sand control device 110 may include a setting module 112, a crossover module 114, and a locating collet 116.

The downhole tool 100 may also include a tubular member (e.g., a wash pipe) 120. The tubular member 120 may be coupled to and positioned below the sand control device 110. The tubular member 120 may include a single joint or multiple joints that are coupled together. An axial bore 122 may extend through the tubular member 120 and at least partially through the sand control device 110.

The downhole tool 100 may also include a shifting device 130. The shifting device 130 may be coupled to the tubular member 120. More particularly, the shifting device 130 may be (or be part of) a separate sub that is coupled to one joint and/or positioned between two joints of the tubular member 120. The shifting device 130 may include one or more engagement members (e.g., collets) 132 that are used to open, close, and/or shift the position of downhole flow control or circulation devices (e.g., sleeves).

The downhole tool 100 may also include a load-monitoring sensor 140. The load-monitoring sensor 140 may be positioned axially-between the sand control device 110 and the shifting device 130. As shown, the load-monitoring sensor 140 may be positioned above and proximate to the shifting device 130. For example, a distance between the load-monitoring sensor 140 and the shifting device 130 may be less than or equal to about 50 m, less than or equal to about 10 m, or less than or equal to about 3 m. By positioning the load-monitoring sensor 140 within the downhole tool 100 and within the distance described above from the shifting device 130, the load-monitoring sensor 140 may yield more accurate results than if positioned above the downhole tool 100 (e.g., within the drill string 160). As shown, the load-monitoring sensor 140 may be coupled to and/or positioned within a separate sub that is coupled to the shifting device 130. In another example, the load-monitoring sensor 140 may be coupled to and/or positioned within a separate sub that is positioned between two joints of the tubular member 120. In yet another example, the load-monitoring sensor 140 may be positioned at least partially within one of the joints of the tubular member 120.

The load-monitoring sensor 140 may measure a load on the shifting device 130 and/or the downhole tool 100 when the shifting device 130 contacts or engages a restriction in the wellbore. More particularly, the load-monitoring sensor 140 may measure how much the load on the downhole tool 100 increases or decreases (i.e., a load differential) in response to the shifting device 130 contacting or engaging the restriction in the wellbore. The load may be an axial tension load, an axial compression load, a rotational load, or a combination thereof. The load-monitoring sensor 140 may be or include a strain gauge, a load cell, or the like. The restriction may be or include a sleeve, a reduced cross-sectional area (e.g., diameter) in the wellbore, a bend in the wellbore, debris in the wellbore, or the like.

The downhole tool 100 may also include a first physical property sensor 150. The first physical property sensor 150 may be positioned axially-between the sand control device 110 and the shifting device 130. As shown, the first physical property sensor 150 may be positioned axially-between the sand control device 110 and the load-monitoring sensor 140. The first physical property sensor 150 may be coupled to and/or positioned within a separate sub that is positioned between two joints of the tubular member 120. In another example, the first physical property sensor 150 may be coupled to and/or positioned within one of the joints of the tubular member 120. In yet another example, the first physical property sensor 150 may be positioned in the same joint or sub as the load-monitoring sensor 140. The first physical property sensor 150 may measure pressure, temperature, wellbore trajectory, or a combination thereof. In other embodiments, the first physical property sensor 150 may also measure formation properties such as resistivity, porosity, sonic velocity, and gamma ray.

The downhole tool 100 (e.g., the sand control device 110) may be coupled to a drill string 160. The drill string 160 may be used to raise and lower the downhole tool 100 within a wellbore. The drill string 160 may include a second physical property sensor 170 coupled thereto and/or positioned therein. For example, the second physical property sensor 170 may be coupled to and/or positioned within one of the joints of the drill string 160. In another example, the second physical property sensor 170 may be coupled to and/or positioned within a separate sub that is positioned between two joints of the drill string 160. As shown, the second physical property sensor 170 may be positioned above and proximate to the downhole tool 100. The second physical property sensor 170 may measure pressure, temperature, wellbore trajectory, or a combination thereof.

Figure 2:
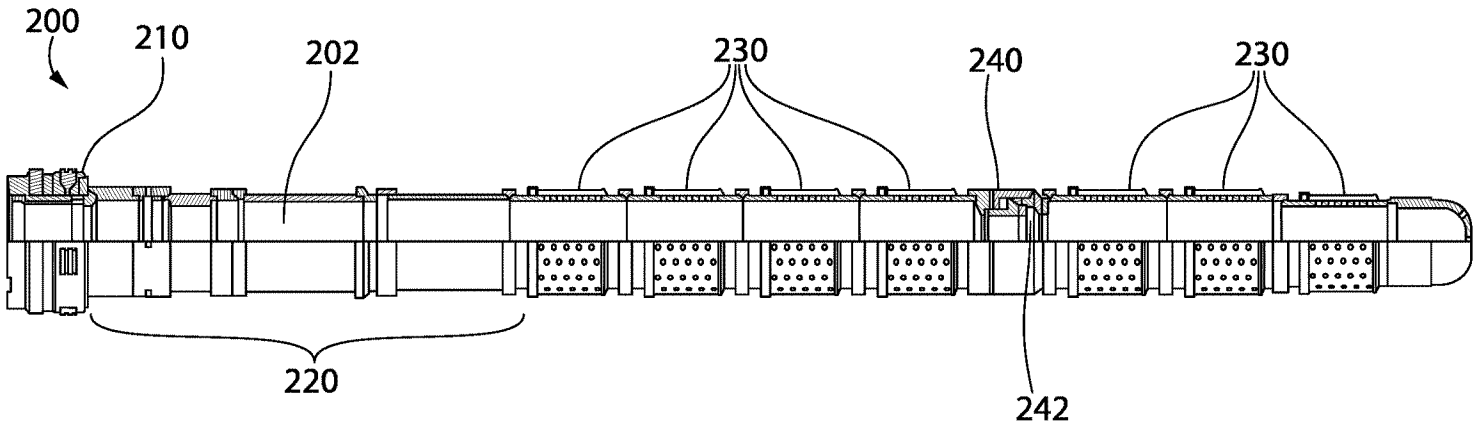
FIG. 2 illustrates a half-sectional side view of a completion assembly, according to an embodiment.

FIG. 2 illustrates a half-sectional side view of a completion assembly 200, according to an embodiment. The completion assembly 200 may have a bore 202 formed axially-therethrough. The completion assembly 200 may include a packer 210 that is configured to expand radially-outward to engage a surrounding tubular member (e.g., a casing or the wall of the wellbore). The completion assembly 200 may also include a gravel pack extension 220. The gravel pack extension 220 may include one or more ports. A sleeve may be configured to prevent flow through the ports in a first position and to allow flow through the ports in a second position. The gravel pack extension 220 may also include a locating/set-down collar. The sleeve and/or the locating/set-down collar may interact with the collet on the sand control device 110.

The completion assembly 200 may also include a fluid-loss device positioned below the gravel pack extension 220. The fluid-loss device may be or include a flapper that allows fluid to flow in one direction, but not the opposing direction. In another embodiment, the fluid-loss device may be or include a ball-type valve that prevents flow in both directions. In yet another embodiment, the fluid-loss device may be a sleeve that opens and closes.

The completion assembly 200 may also include one or more screens (seven are shown: 230). The screens 230 may include a plurality of openings that are sized to allow fluid and particles having a cross-sectional length (e.g., diameter) less than a predetermined amount to pass therethrough, while preventing particles having a cross-sectional length (e.g., diameter) greater than a certain amount from passing therethrough.

The completion assembly 200 may also include one or more sleeves (one is shown: 240). The sleeve 240 may include an engagement member 242 that is configured to engage (e.g., receive) the engagement member 132 of the shifting device 130. The engagement member 242 of the sleeve 240 may be or include a groove. As described in greater detail below, when the engagement member 132 of the shifting device 130 is engaged with the engagement member 242 of the sleeve 240, axial movement of the downhole tool 100 with respect to the completion assembly 200 may cause the sleeve 240 to shift from a first position (e.g., closed) to a second position (e.g., open). In one example, when the sleeve 240 is in the first position, the sleeve 240 may allow fluid flow through an opening, and when the sleeve 240 is in the second position, the sleeve 240 may prevent fluid flow through the opening.

Figure 3:
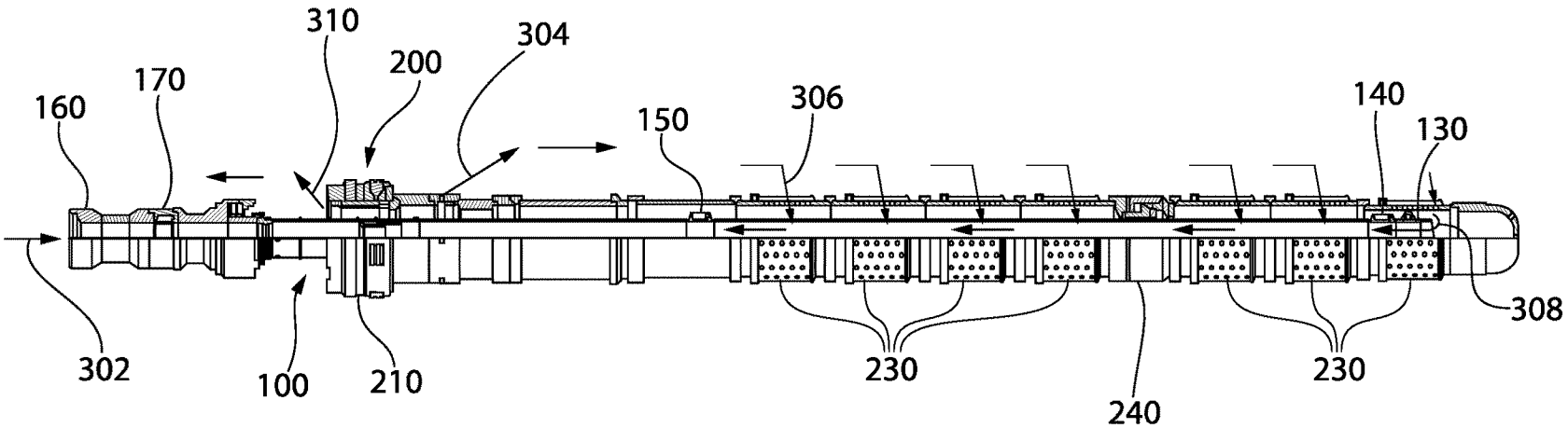
FIG. 3 illustrates a half-sectional side view of the downhole tool positioned within the completion assembly, according to an embodiment.

FIG. 3 illustrates a half-sectional side view of the downhole tool 100 positioned within the completion assembly 200, according to an embodiment. As shown, the downhole tool 100 may be run into a wellbore and inserted at least partially into the completion assembly 200. Although shown as axially-offset from the sleeve 240 in FIG. 3, as described in greater detail below, the downhole tool 100 may be moved (e.g., picked up) with respect to the completion assembly 200 to allow the engagement member 132 of the shifting device 130 to engage the engagement member 242 of the sleeve 240.

A gravel slurry may be pumped into the wellbore when the downhole tool 100 is positioned within the completion assembly 200. The gravel slurry may flow down the drill string 160, as shown by arrow 302. The gravel slurry may then flow out of the crossover in the sand control device 110 and into an annulus between the completion assembly 200 and the surrounding tubular (e.g., casing or wall of the wellbore), as shown by arrow 304. A portion of the gravel slurry (e.g., a carrier fluid) may flow from the annulus between the surrounding tubular and the completion assembly 200, through the screens 230, and into an annulus between the completion assembly and the downhole tool 100, as shown by arrows 306. Gravel particles from the gravel slurry may remain in the annulus between the surrounding tubular and the completion assembly 200 when the carrier fluid flows through the screens 230. The carrier fluid may then flow into the tubular member 120 through an end thereof, as shown by arrow 308. The carrier fluid may then flow through the crossover in the sand control device 110 and into an annulus between the drill string 160 and the surrounding tubular, as shown by arrow 310.

Figure 4:
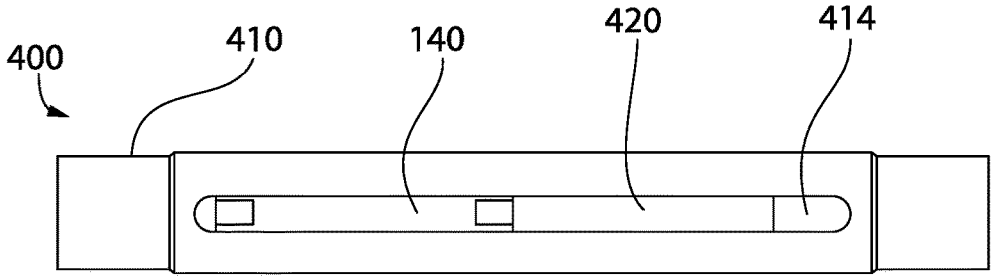
FIG. 4 illustrates a side view of a sub having a load-monitoring sensor coupled thereto and/or positioned therein, according to an embodiment.
Figure 5:
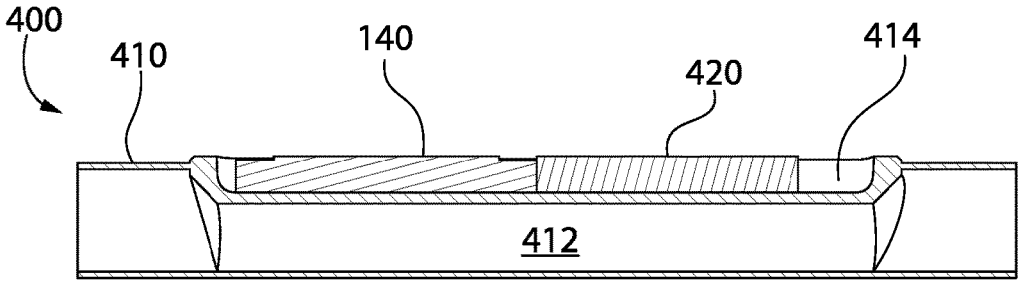
FIG. 5 illustrates a cross-sectional side view (rotated 90° from FIG. 4) of the sub shown in FIG. 4, according to an embodiment.

FIG. 4 illustrates a side view of a sub 400 having the load-monitoring sensor 140 coupled thereto and/or positioned therein, and FIG. 5 illustrates a cross-sectional side view (rotated 90° from FIG. 4) of the sub 400 shown in FIG. 4, according to an embodiment. As mentioned above, the sub 400 may be coupled to the tubular member 120 and/or the shifting device 130 shown in FIG. 1.

The sub 400 may include a body (also referred to as a mandrel) 410. In at least one embodiment, the body 410 may be eccentric. The body 410 may have an axial bore 412 formed therethrough. The axial bore 412 of the body 410 may be aligned, and in fluid communication, with the axial bore 122 of the tubular member 120. The carrier fluid may flow through the axial bore 412 of the body 410.

The body 410 may also define a recess 414 in an outer surface thereof. The load-monitoring sensor 140 may be or include a load cell that is positioned at least partially within the recess 414 formed in the outer surface of the body 410. When the shifting device 130 encounters a restriction (e.g., the sleeve 240) in the wellbore, the load-monitoring sensor 140 may measure the load induced by the engagement between the shifting device 130 and the restriction (e.g., the sleeve 240). A memory module 420 may also be positioned at least partially within the recess 414 formed in the outer surface of the body 410. The measurement from the load-monitoring sensor 140 may be recorded/stored in the memory module 420.

Figure 6:
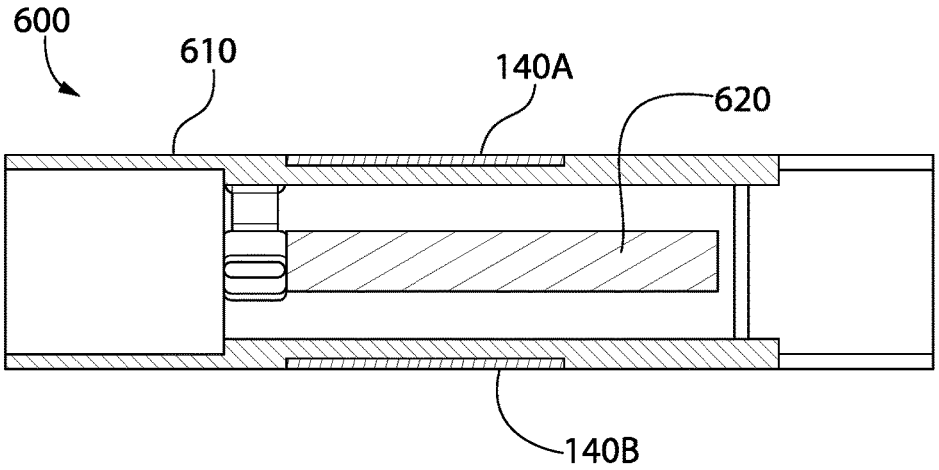
FIG. 6 illustrates a cross-sectional side view of another sub having the load-monitoring sensor coupled thereto and/or positioned therein, according to an embodiment.

FIG. 6 illustrates a cross-sectional side view of another sub 600 having one or more load-monitoring sensors (two are shown: 140A, 140B) coupled thereto and/or positioned therein, according to an embodiment. As mentioned above, the sub 600 may be coupled to the tubular member 120 and/or the shifting device 130 shown in FIG. 1. The sub 600 may include a body (also referred to as a mandrel) 610. The body 610 may define one or more recesses in an outer surface thereof. As shown, the recesses may be circumferentially-offset from one another.

The load-monitoring sensors 140A, 140B may be or include strain gauges that are positioned at least partially within the recesses formed in the outer surface of the body 610. For example, the load-monitoring sensors 140A, 140B may be circumferentially-offset from one another. When the shifting device 130 encounters a restriction (e.g., the sleeve 240) in the wellbore, the load-monitoring sensors 140A, 140B may measure the load induced by the engagement between the shifting device 130 and the restriction (e.g., the sleeve 240). The measurement may be stored in the memory module 620.

Figure 7:
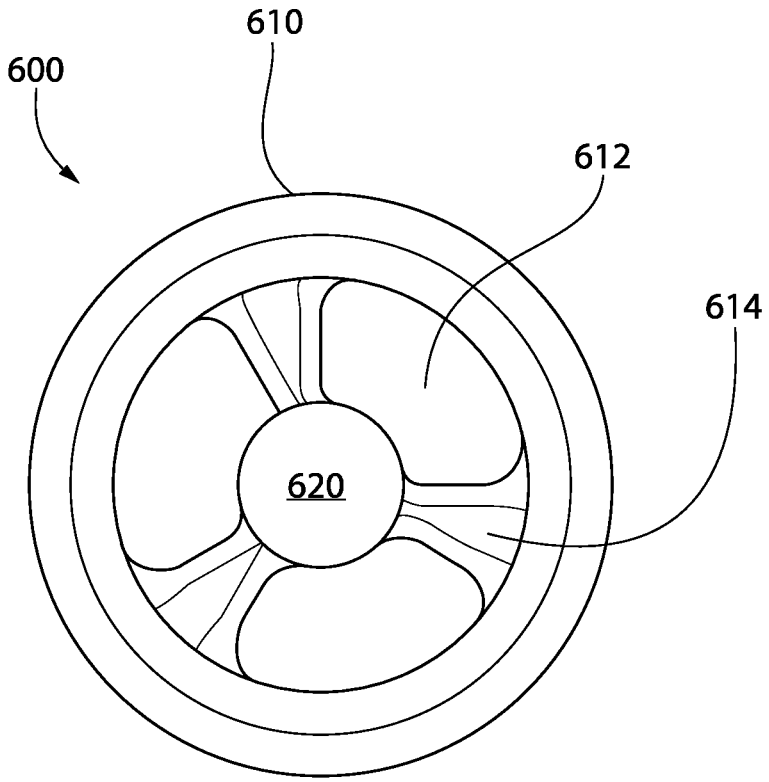
FIG. 7 illustrates an end view of the sub shown in FIG. 6, according to an embodiment.

FIG. 7 illustrates an end view of the sub 600 shown in FIG. 6, according to an embodiment. Referring to FIGS. 6 and 7, the memory module 620 may be positioned within the body 610. For example, the memory module 620 may be positioned radially-inward from the body 610 such that a central longitudinal axis through the body 610 extends through the memory module 620.

One or more support members (three are shown: 614) may extend radially-between the body 610 and the memory module 620. The support members 614 may be coupled to or integral with the body 610. One or more axial flow channels (three are shown: 612) may be positioned radially-outward from the memory module 620. For example, each axial flow channel 612 may be positioned circumferentially-between two radial support members 614. The axial flow channels 612 may provide a path of fluid communication through the sub 600. For example, the carrier fluid may flow through the axial flow channels 612.

Figure 8:
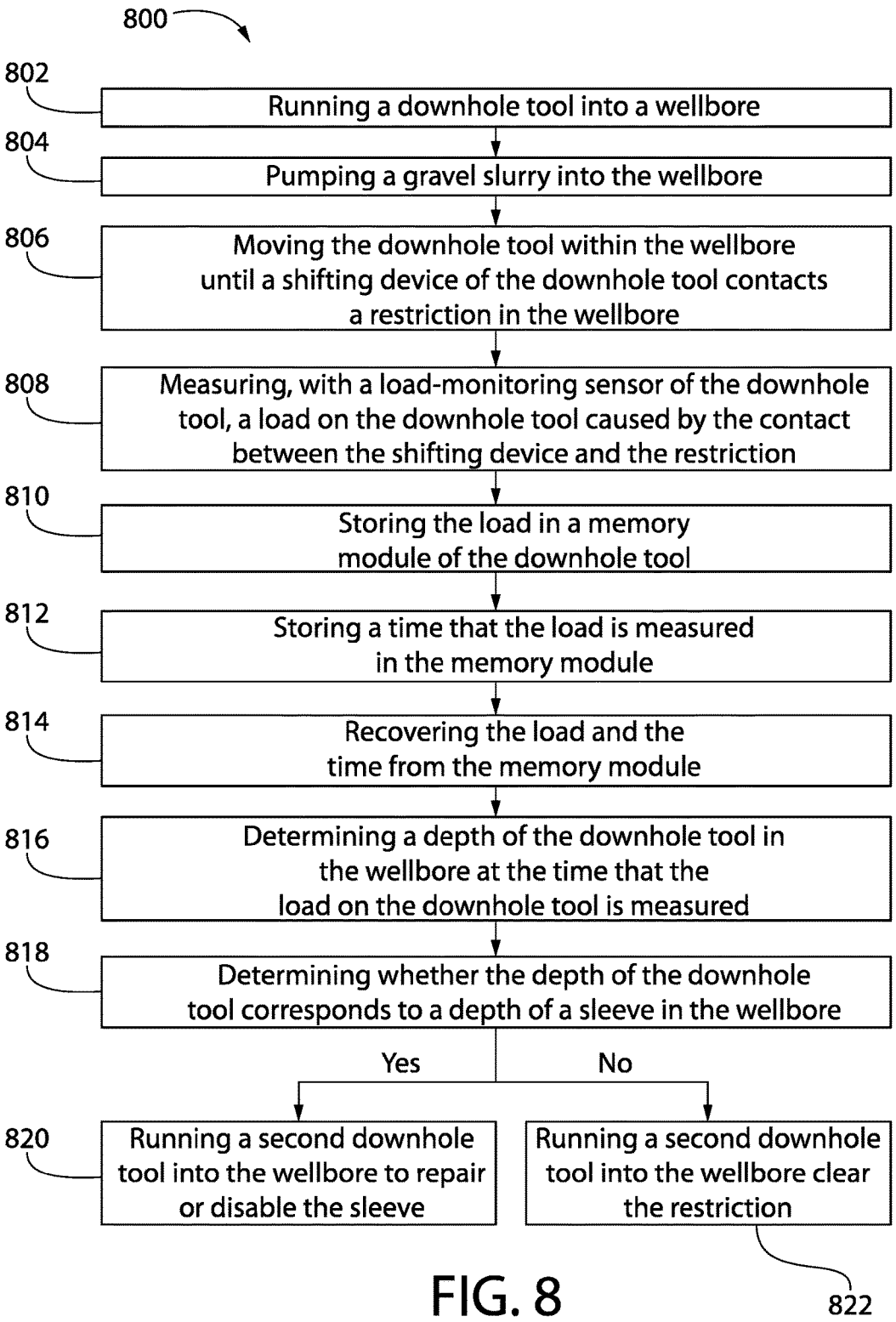
FIG. 8 illustrates a flowchart of a method for determining a load on a shifting device, according to an embodiment.
Figure 9:
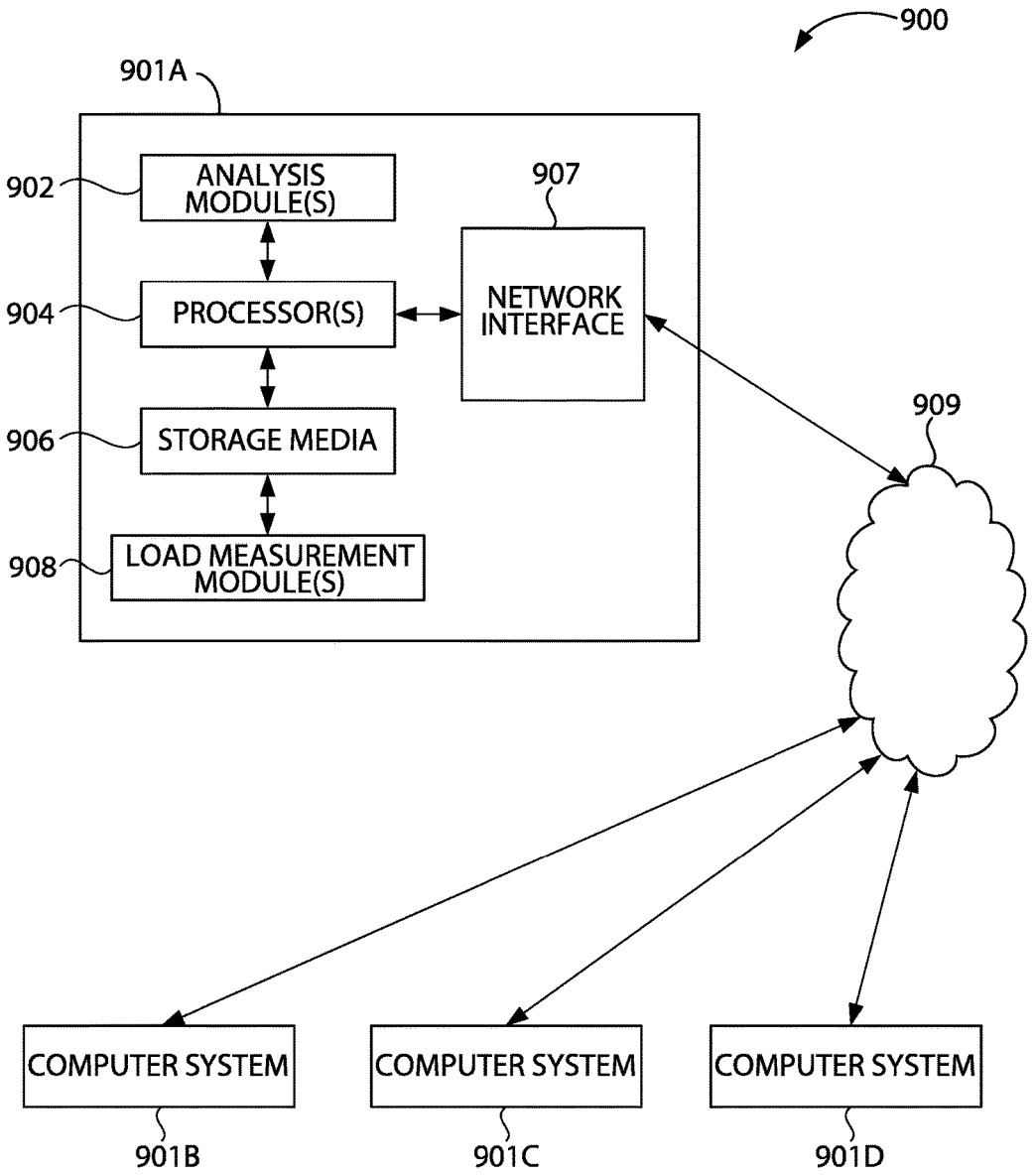
FIG. 9 illustrates a schematic view of a computing system for performing at least a portion of the method, according to an embodiment.

FIG. 8 illustrates a flowchart of a method 800 for determining a load on a shifting device 130, according to an embodiment. The method 800 may include running the downhole tool 100 into a wellbore, as at 802. In at least one embodiment, the downhole tool 100 may be run into a completion assembly 200 that is positioned within the wellbore, as shown in FIG. 3.

The method 800 may also include pumping a gravel slurry into the wellbore, as at 804. This is described in greater detail above with respect to FIG. 3. Before or after the gravel slurry is pumped into the wellbore, the method 800 may also include moving the downhole tool 100 axially within the wellbore until the shifting device 130 contacts a restriction in the wellbore, as at 806. As mentioned above, in at least one embodiment, the restriction may be the sleeve 240 in the completion assembly 200, and contacting the restriction may include engaging the sleeve 240 with the shifting device 130.

The method 800 may also include measuring, with the load-monitoring sensor 140, a load on the downhole tool 100 (e.g., on the shifting device 130) caused by the contact/engagement between the shifting device 130 and the restriction, as at 808. The method 800 may also include storing the measured load in a memory module 420, 620 in the downhole tool 100, as at 810. In at least one embodiment, the method 800 may also include storing a time that the load is measured (i.e., a time stamp) in the memory module 420, 620, as at 812.

The method 800 may also include recovering the measured load and the time from the memory module 420, 620, as at 814. In at least one embodiment, the downhole tool 100 may be pulled back to the surface to recover the measured load. In another embodiment, the downhole tool 100 may include a telemetry module (not shown) that may transmit the measured load up to the surface while the downhole tool 100 is in the wellbore. For example, the telemetry module may transmit the measured load using mud-pulse telemetry or electromagnetic ("EM") telemetry.

The method 800 may also include determining a depth of the downhole tool 100 in the wellbore at a time that the load on the downhole tool 100 is measured, as at 816. The depth of the downhole tool 100 may be determined by comparing the time that the load is measured (i.e., the time stamp) against a log maintained by an operator at the surface. The log may include the depth of the downhole tool 100 versus time. The depth of the downhole tool 100 may be measured, for example, by adding up the length of the joints that make up the drill string 160.

The method 800 may also include determining whether the depth of the downhole tool 100 corresponds to a depth of the sleeve 240 in the wellbore, as at 818. The depth of the sleeve 240 in the wellbore may be known. Thus, the operator may compare the depth of the downhole tool 100 to the depth of the sleeve 240 to determine whether the depth of the downhole tool 100 corresponds to the depth of the sleeve 240. When the depth of the downhole tool 100 corresponds to the depth of the sleeve 240, and the measured load on the downhole tool 100 is greater than a predetermined threshold, indicating that the sleeve 240 is not functioning (e.g., shifting) properly, the method 800 may include pulling the downhole tool 100 out of the wellbore, and running a second downhole tool into the wellbore to repair or disable the sleeve 240, as at 820. When the depth of the downhole tool 100 does not correspond to the depth of the sleeve 240, this may indicate that the restriction is not the sleeve 240. Rather, the restriction may be or include debris in the wellbore. When the depth of the downhole tool 100 does not correspond to the depth of the sleeve 240, and the measured load on the downhole tool 100 is greater than a predetermined threshold, the method 800 may include pulling the downhole tool 100 out of the wellbore, and running a second downhole tool into the wellbore clear the restriction, as at 822.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members." As used herein, "about," "approximately," "substantially," and "significantly" will be understood by persons of ordinary skill in the art and will vary to some extent on the context in which they are used. If there are uses of the term which are not clear to persons of ordinary skill in the art given the context in which it is used, "about" and "approximately" will mean plus or minus 10% of the particular term and "substantially" and "significantly" will mean plus or minus 10% of the particular term.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. Moreover, the order in which the elements of the methods described herein are illustrate and described may be re-arranged, and/or two or more elements may occur simultaneously. The embodiments were chosen and described in order to best explain the principals of the invention and its practical applications, to thereby enable others skilled in the art to best utilize the invention and various embodiments with various modifications as are suited to the particular use contemplated.

What is claimed is:

1. A downhole tool, comprising:

a shifting device;

a load-monitoring sensor positioned above the shifting device, wherein a distance between the shifting device and the load-monitoring sensor is less than or equal to about 10 m, wherein the load-monitoring sensor is configured to measure an amount by which a load on the downhole tool changes in response to the shifting device contacting a restriction in a wellbore, wherein the load comprises an axial tension load, an axial compression load, a rotational load, or a combination thereof; and a body having a bore formed axially-therethrough and a recess formed in an outer surface thereof, wherein the load-monitoring sensor is positioned at least partially within the recess.

2. The downhole tool of claim 1, wherein the restriction comprises a sleeve in the wellbore.

3. The downhole tool of claim 1, wherein the restriction comprises a reduced cross-sectional area in the wellbore, a bend in the wellbore, or debris in the wellbore.

4. The downhole tool of claim 1, further comprising a memory module positioned within the recess, wherein data representing the amount by which the load on the downhole tool increases or decreases is stored in the memory module.

5. The downhole tool of claim 1, wherein the body is eccentric.

6. The downhole tool of claim 1, further comprising:

a memory module positioned radially-inward from an inner surface of the body; and a plurality of circumferentially-offset radial support members extending between the body and the memory module, wherein the axial bore is positioned circumferentially-between two of the radial support members.

7. The downhole tool of claim 1, wherein the body is coupled to the shifting device.

8. The downhole tool of claim 1, wherein the load-monitoring sensor comprises a strain gauge.

9. The downhole tool of claim 1, wherein the load-monitoring sensor comprises a load cell.

10. The downhole tool of claim 1, wherein the downhole tool is configured to be coupled to a drill string comprising a physical property sensor.

11. The downhole tool of claim 1, wherein the physical property sensor measures at least one of pressure, temperature, and a wellbore trajectory.

12. A downhole tool, comprising:

a shifting device;

a first load-monitoring sensor positioned above the shifting device, wherein a first distance between the shifting device and the first load-monitoring sensor is less than or equal to about 10 m, a second load monitoring sensor positioned above the shifting device, wherein a second distance between the shifting device and the second load-monitoring sensor is less than or equal to about 10 m, wherein the first and second load-monitoring sensors are configured to measure an amount by which a load on the downhole tool changes in response to the shifting device contacting a restriction in a wellbore, wherein the load comprises an axial tension load, an axial compression load, a rotational load, or a combination thereof; and a body having a bore formed axially-therethough and first and second recesses formed in an outer surface thereof, wherein the first load-monitoring sensor is positioned at least partially within the first recess, and wherein the second load-monitoring sensor is positioned at least partially within the second recess.

13. The downhole tool of claim 12, wherein the first recess is circumferentially-offset from the second recess.

14. The downhole tool of claim 12, wherein the restriction comprises a sleeve in the wellbore.

15. The downhole tool of claim 12, wherein the restriction comprises a reduced cross-sectional area in the wellbore, a bend in the wellbore, or debris in the wellbore.

16. The downhole tool of claim 12, further comprising a memory module positioned within the body, wherein data representing the amount by which the load on the downhole tool increases or decreases is stored in the memory module.

17. The downhole tool of claim 12, wherein the body is eccentric.

18. The downhole tool of claim 12, wherein the body is coupled to the shifting device.

* * * * *